US008985023B2

(12) United States Patent
Mason

(10) Patent No.: US 8,985,023 B2
(45) Date of Patent: Mar. 24, 2015

(54) EXPLOSIVE DEVICE BOOSTER ASSEMBLY AND METHOD OF USE

(75) Inventor: Justin Lee Mason, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 56 days.

(21) Appl. No.: 13/879,316

(22) PCT Filed: May 3, 2012

(86) PCT No.: PCT/US2012/036410

§ 371 (c)(1),
(2), (4) Date: Apr. 12, 2013

(87) PCT Pub. No.: WO2013/165434

PCT Pub. Date: Nov. 7, 2013

(65) Prior Publication Data

US 2013/0291711 A1 Nov. 7, 2013

(51) Int. Cl.

| | |
|---|---|
| ***F42B 3/02*** | (2006.01) |
| ***E21B 29/02*** | (2006.01) |
| ***F42B 3/10*** | (2006.01) |
| ***E21B 43/117*** | (2006.01) |
| ***E21B 43/119*** | (2006.01) |
| ***F42D 1/02*** | (2006.01) |
| ***F42D 1/04*** | (2006.01) |

(52) U.S. Cl.

CPC . *E21B 29/02* (2013.01); *F42B 3/10* (2013.01); *E21B 43/117* (2013.01); *E21B 43/119* (2013.01); *F42B 3/02* (2013.01); *F42D 1/02* (2013.01); *F42D 1/043* (2013.01)

USPC ..... 102/275.5

(58) Field of Classification Search

CPC . E21B 43/117; E21B 43/1185; E21B 43/263; F42B 3/08; F42B 3/107

USPC ..... 102/310, 317, 275.3, 275.4, 275.5, 304, 102/275.12, 275.11, 275.2; 89/1.151, 1.15, 89/1.14; 175/4.55, 4.56, 4.57, 4.58, 4.59

See application file for complete search history.

(56) References Cited

U.S. PATENT DOCUMENTS

| | | | | | |
|---|---|---|---|---|---|
| 3,260,202 | A | * | 7/1966 | Bryla | 102/275.5 |
| 3,990,367 | A | * | 11/1976 | Smith | 102/275.4 |
| 4,248,152 | A | * | 2/1981 | Yunan | 102/275.4 |
| 4,335,652 | A | * | 6/1982 | Bryan | 102/202.1 |
| 5,009,163 | A | * | 4/1991 | Robins et al. | 102/301 |

(Continued)

OTHER PUBLICATIONS

Foreign Communication from a Related Counterpart Application, International Search Report and Written Opinion, International Application No. PCT/US12/36410, filed on May 3, 2012 2011-IP-051060U1US 4391-03100.

*Primary Examiner* — Samir Abdosh
*Assistant Examiner* — John D Cooper
(74) *Attorney, Agent, or Firm* — Chamberlain Hrdlicka

(57) ABSTRACT

An apparatus for perforating a wellbore comprises a housing, at least one perforating charge disposed within the housing, a detonation cord coupled to the at least one perforating charge, and a booster coupled to an end of the detonation cord. The booster comprises a booster body having a first end and a second end, a cavity defined within the booster body between the first end and the second end, an explosive material disposed within the cavity adjacent the first end, and a locking feature disposed adjacent the second end, where the locking feature is configured to allow the booster to engage the end of the detonation cord in a first direction and resist movement in a second direction.

20 Claims, 8 Drawing Sheets

(56) References Cited

U.S. PATENT DOCUMENTS

| | | | | | |
|---|---|---|---|---|---|
| 5,159,145 | A | * | 10/1992 | Carisella et al. | 89/1.15 |
| 5,417,162 | A | * | 5/1995 | Adams et al. | 102/317 |
| 5,515,784 | A | * | 5/1996 | Peebles | 102/275.3 |
| 5,665,932 | A | * | 9/1997 | Viljoen et al. | 102/275.7 |
| 5,689,083 | A | * | 11/1997 | Hadden | 102/275.2 |
| 5,945,627 | A | | 8/1999 | Arpin et al. | |
| 6,006,671 | A | * | 12/1999 | Yunan | 102/275.11 |
| 6,247,410 | B1 | | 6/2001 | Garcia | |
| 7,197,985 | B2 | * | 4/2007 | Markel et al. | 102/524 |
| 7,387,156 | B2 | | 6/2008 | Drummond et al. | |
| 8,596,378 | B2 | | 12/2013 | Mason et al. | |
| 2004/0216632 | A1 | * | 11/2004 | Finsterwald | 102/310 |

* cited by examiner

EXPLOSIVE DEVICE BOOSTER ASSEMBLY AND METHOD OF USE

CROSS-REFERENCE TO RELATED APPLICATIONS

This application claims priority to and is a 371 National Stage of International Application No. PCT/US2012/036410 entitled, "Explosive Device Booster Assembly and Method of Use", filed on May 3, 2012, by Justin Lee Mason, and is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

During drilling and upon completion and production of an oil and/or gas wellbore, a workover and/or completion tubular string can be installed in the wellbore to allow for production of oil and/or gas from the well. Current trends involve the production of oil and/or gas from deeper wellbores with more hostile operating environments. In order to produce the oil and/or gas from the wellbore, the wellbore is typically perforated to provide one or more fluid pathways through a casing lining the wellbore to the subterranean formation containing the oil and/or gas.

During the process of perforating an oil or gas well, a perforating gun assembly can be lowered into and positioned within the wellbore. A typical perforating gun assembly consists of one or more perforating guns, as well as possibly some spacer sections. If the zone to be perforated is longer than the amount which can be perforated with a single gun, then multiple perforating guns are connected together to create a perforating gun assembly of the desired length. Further, if there is more than one zone to be perforated and there is some distance between the zones to be perforated, spacer sections may be inserted between the guns in the gun assembly. These spacer sections have detonation cord running from end to end, to transfer the detonation through each spacer section to the next component. In order for the explosive transfer to occur from one section to the next in the gun assembly, an explosive transfer system may be employed.

SUMMARY

In an embodiment, an apparatus for perforating a wellbore comprises a housing, at least one perforating charge disposed within the housing, a detonation cord coupled to the at least one perforating charge, and a booster coupled to an end of the detonation cord. The booster comprises a booster body having a first end and a second end, a cavity defined within the booster body between the first end and the second end, an explosive material disposed within the cavity adjacent the first end, and a locking feature disposed adjacent the second end, where the locking feature is configured to allow the booster to engage the end of the detonation cord in a first direction and resist movement in a second direction.

In an embodiment, a booster for use with an explosive device assembly comprises a booster body comprising a first end and a second end, an explosive material disposed within the booster body adjacent the first end, and a locking feature disposed adjacent the second end. The locking feature is configured to allow the second end of the booster body to receive an end of a detonation cord, and the locking feature is configured to couple the detonation cord to the booster body.

In an embodiment, a method for preparing a perforating gun assembly for use in a wellbore comprises providing a perforating gun comprising a housing, at least one perforating charge disposed within the housing, and a detonation cord coupled to the at least one perforating charge, and coupling a booster to an end of the detonation cord. The booster comprises a locking feature configured to allow the booster to engage the end of the length of the detonation cord in a first direction and resist movement in the opposite direction.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
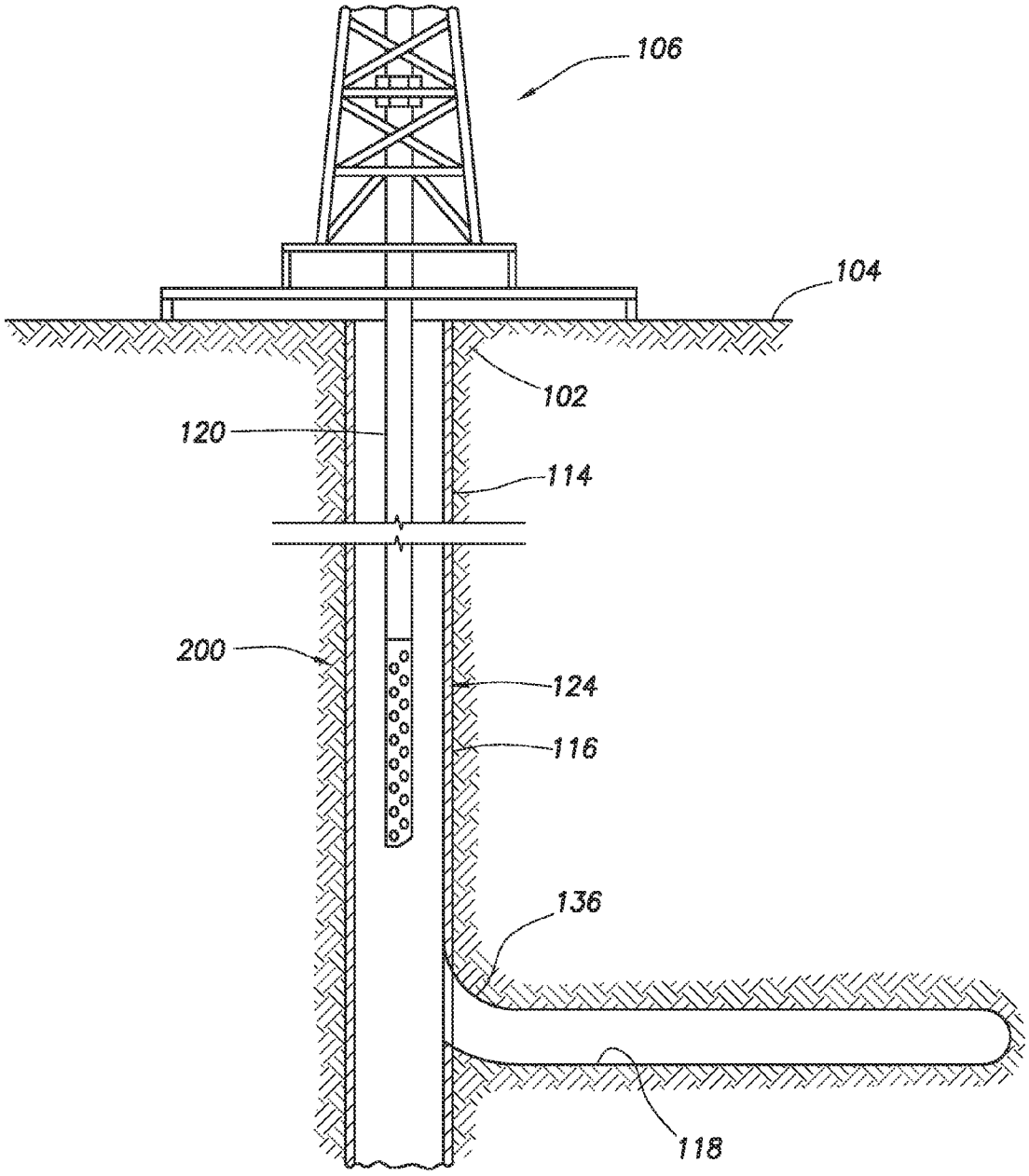
FIG. 1 is a schematic view of an oil rig and wellbore according to an embodiment.

In the drawings and description that follow, like parts are typically marked throughout the specification and drawings with the same reference numerals, respectively. The drawing figures are not necessarily to scale. Certain features of the disclosure may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation.

The use of the locking feature as described herein, alone or in combination with a manual crimping operation, may beneficially allow for a consistent and reliable coupling of a detonation cord to a booster. This may limit or reduce the improper couplings between the detonation cord and the booster, which may result in terminating the detonation wave prior to the desired end point. Current manual crimping processes involve the manual alignment of an end of the detonation cord with a booster body followed by the use of a hand crimping tool. In this process, the end of the detonation cord may be inserted into a cavity in the booster body and the crimping tool may deform the booster body to couple the detonation cord to the booster body. However, the use of a manual alignment process may result in the possibility of an alignment error and a failure of the detonation cord to properly engage a booster explosive disposed within the booster body. Rather than use a crimping process, the locking feature described herein may allow the detonation cord to be inserted into the booster body in a first direction and then resist movement in the opposite direction. For example, the locking feature can comprise teeth that are angled into the booster body and allow the detonation cord to be inserted into the booster body, but bite into the detonation cord if it is pulled out of the booster body. Similarly, various adhesives and external retaining members can also be used to allow the detonation cord to be inserted and then retained within the booster body without the need for any special crimping tools. As a result, the detonation cord can be inserted into the booster body by hand and then maintained in the proper alignment without the need for a further manual crimping step.

Use of the locking feature disclosed herein, alone or in combination with a crimp, may provide a more consistent and reliable coupling between the detonation cord and the booster explosive, thereby improving the reliability of the chain of explosives used in the detonation process. As described herein, actuation of the locking feature may be performed without any special tools, and a crimp performed in combination with a locking feature may be performed by hand. The locking feature described herein may also have cost and safety benefits. For example, an improper, incomplete, and/or missing crimp may result in the failure of a charge to detonate, thereby resulting in the failure of subsequent charges in the chain to detonate as well. In this case, the entire perforating gun assembly may need to be withdrawn from the wellbore, which can be a costly process that takes several days while presenting the possibility of a misfire while being withdrawn from the wellbore. The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 illustrates a schematic view of an embodiment of a rig and wellbore. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells.

A wellbore tubular string 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string disposed in the wellbore 114. It should be understood that the wellbore tubular 120 is equally applicable to any type of wellbore tubular being inserted into a wellbore including as non-limiting examples drill pipe, casing, liners, jointed tubing, and/or coiled tubing. Further, the wellbore tubular 120 may operate in any of the wellbore orientations (e.g., vertical, deviated, horizontal, and/or curved) and/or types described herein. In an embodiment, the wellbore may comprise wellbore casing, which may be cemented into place in the wellbore 114. In an embodiment, the wellbore tubular string 120 may comprise a completion assembly string comprising one or more wellbore tools, which may take various forms. For example, a zonal isolation device may be used to isolate the various zones within a wellbore 114 and may include, but is not limited to, a plug, a valve (e.g., lubricator valve, tubing retrievable safety valve, fluid loss valves, etc.), and/or a packer (e.g., production packer, gravel pack packer, frac-pac packer, etc.). The downhole tools may comprise the perforating gun assembly 200.

Figure 2:
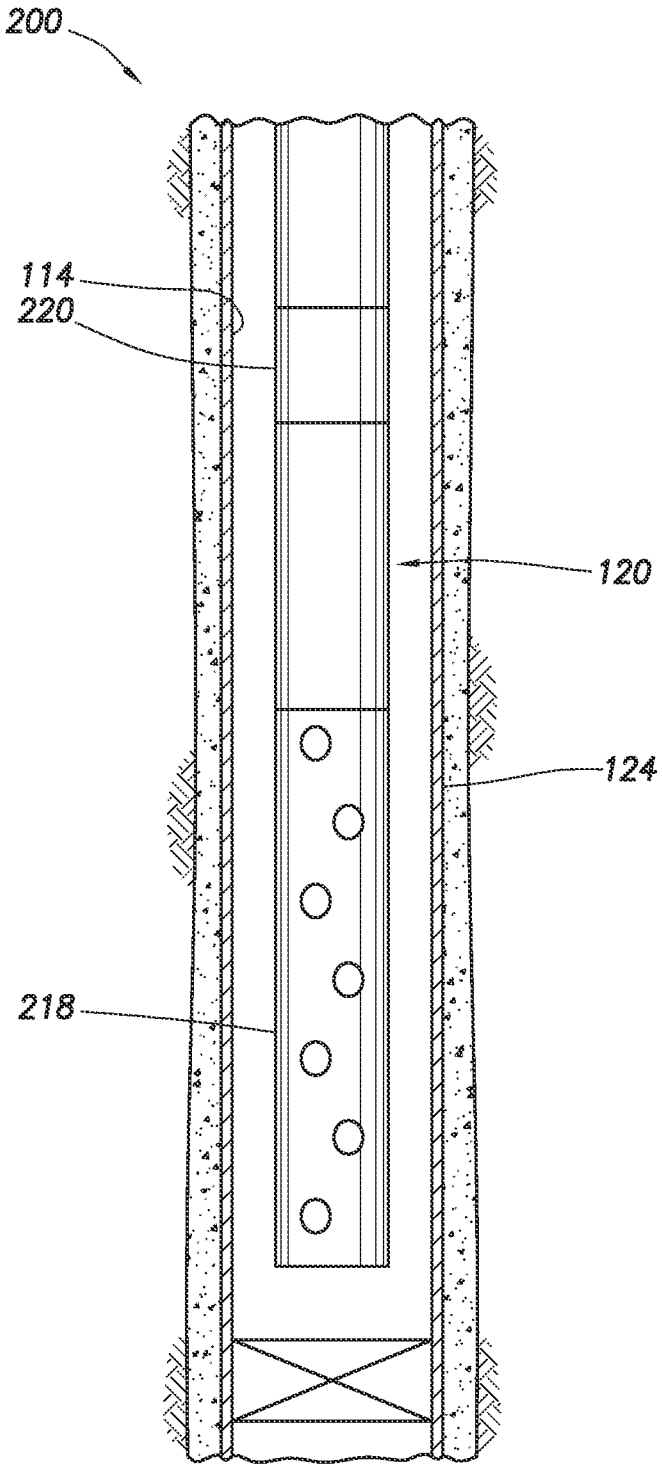
FIG. 2 is a schematic view of an perforating gun assembly according to an embodiment.

FIG. 2 illustrates a close up view of the perforating gun system 200 as shown in FIG. 1. The perforating gun assembly 200 generally comprises a perforating gun 218 and a detonator 220. The perforating gun 218 may be of conventional design which may include one or more perforating charges (e.g., shaped charges) that are detonated in order to perforate casing 124 lining the wellbore 114. The perforating gun 218 may also include other elements such as detonation cord, boosters, and/or other types of detonation transfer components. In an embodiment, the perforating gun assembly may include multiple perforating guns 218 and any number of additional components (e.g., end caps, blank sections, spacers, transfer subs, etc.), which may be assembled in a string.

The detonator 220 may also be of conventional design. In general, the detonator is configured to initiate a detonation wave used to actuate the explosives along the length of the perforating gun assembly 200. Any suitable method of actuating the detonator 220 may be used, such as application of a predetermined pressure, transmission of a pressure, electrical or telemetry signal, mechanical actuation, or any combination thereof. In an embodiment, the detonator 220 may be positioned at a lower end of the perforating assembly 200 below the perforating gun 218. In an embodiment, the detonator 220 may be positioned above the perforating gun 218, and various methods of actuating the firing head (such as dropping a weighted bar through the tubular string 120, applying pressure to the tubular string 120 without also applying pressure to the wellbore about the perforating gun 218, etc.) may be used.

Figures 3A, 3B:
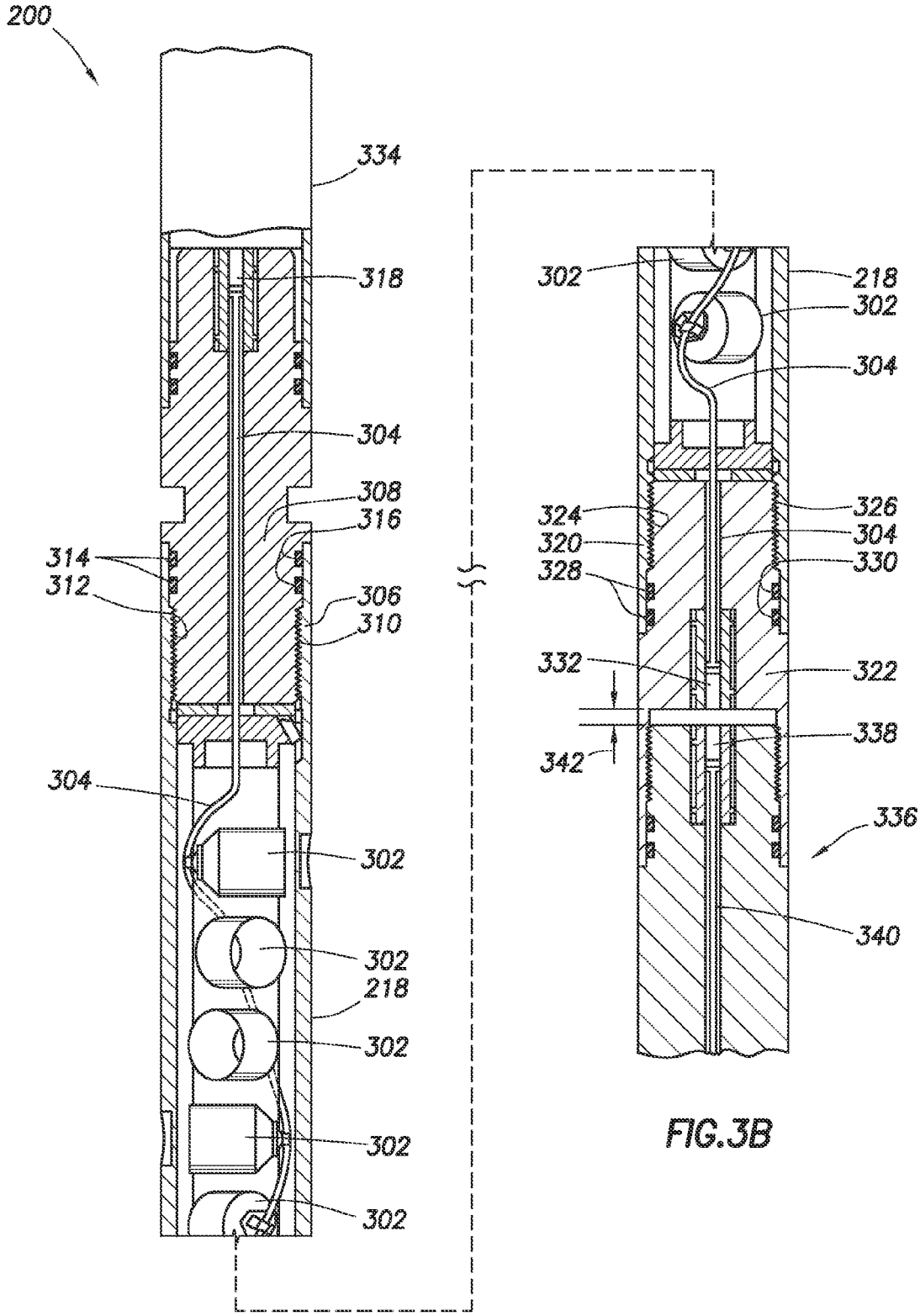
FIGS. 3A and 3B are cross-sectional views of perforating gun modules according to an embodiment.

FIGS. 3A and 3B illustrate cross-sectional views of a perforating gun assembly 200. More specifically, perforating gun 218 comprises perforating charges 302 held in a helical configuration. Any other configuration or pattern of charges 302 as is well known in the art could be used. In an embodiment, the perforating gun assembly 200 could be used with any type of perforating gun 218 or any explosive device. While the perforating gun 218 is shown as a single perforating gun in an embodiment, it is to be understood that the perforating gun 218 could consist of one, two, or more perforating guns 218 coupled together, as long as the finally constructed perforating gun 218 can be fitted into a wellbore.

The perforating charges 302 are explosively coupled via a detonation cord 304. The detonation cord 304 can be configured to transfer the detonation wave down the length of the perforating gun assembly 200, thereby sequentially detonating each of the perforating charges 302 in rapid succession. In an embodiment, the detonation cord 304 conveys the detonation wave between one or more booster charges 318, 332 disposed at opposite ends of a component of the perforating gun assembly 200. The detonation cord 304 generally comprises a cord-like structure having a generally cylindrical cross section, though other cross-sectional shapes may also be possible. The detonation cord 304 is generally thin and flexible to allow the detonation cord 304 to be installed and routed within the various components making up the perforating gun assembly 200. In an embodiment, the detonation cord 304 comprises a layered structure having an internal explosive core, an optional fiber reinforcement, and an exterior shielding.

In an embodiment, the perforating gun 218 may comprise a first end 306 that is coupled (e.g., threadedly connected) to a first end cap 308. The first end cap 308 may generally be coupled to the perforating gun assembly 200 through the use of a corresponding coupling mechanism, such as threads 310 which are complementary to threads 312 on the perforating gun assembly 200. One or more seals 314 (e.g., O-rings) may be disposed in corresponding grooves 316, and are sealingly captured between the perforating gun assembly 200 and the first end cap 308 when the perforating gun assembly 200 and the first end cap 308 are engaged. The connection between gun section threads 312 and end cap threads 310, along with the captured seals 314, may create a substantially pressure tight seal. The detonation cord 304 may continue through the first end cap 308, to provide a continuous path for the explosive transfer, being coupled finally to a booster 318. The first end cap 308 may comprise one or more features to allow the first end cap 308 to be operably connected to another component above the first end cap 308 such as another perforating gun 218, a wellbore tubular section, a blank section, a spacer, a transfer sub, etc. In an embodiment, a detonator 334 may be coupled to the first end cap 308 for initiating the explosive chain through the perforating gun assembly 200.

The perforating gun 218 may comprise a second end 320 that is coupled (e.g., threadedly connected) to a second end cap 322. The second end cap 322 may be the same or similar to the first end cap 308. The second end cap 322 may generally be coupled to the perforating gun assembly 200 through the use of a corresponding coupling mechanism, such as threads 324 which are complementary to threads 326 on the perforating gun assembly 200. One or more seals 328 (e.g., O-rings) may be disposed in corresponding grooves 330, and are sealingly captured between the perforating gun assembly 200 and the second end cap 322 when the perforating gun assembly 200 and the second end cap 322 are engaged. The connection between gun section threads 326 and end cap threads 324, along with the captured seals 328, may create a substantially pressure tight seal. The detonation cord 304 may continue through the second end cap 322, to provide a continuous path for the explosive transfer, being coupled finally to a second booster 332.

The second end cap 322 may comprise one or more features to allow the second end cap 322 to be operably connected to an additional component 336 forming a portion of the perforating gun assembly 200 below the second end cap 322 such as another perforating gun 218, a wellbore tubular section, a blank section, a spacer, a transfer sub, etc. In an embodiment, the additional component 336 may comprise a booster 338 coupled to a detonation cord 340, and the additional component 336 may be coupled to the second end cap 322 in a manner similar to that discussed with respect to the coupling of the second end 320 of the perforating gun 218 with the second end cap 322. The detonation cord 340 in the additional component 336 may then be configured to transfer a detonation wave to subsequent explosives such as a subsequent booster and/or perforating charges.

As illustrated in FIG. 3B, a gap 342 may be disposed between the second end cap 322 and the additional component 336. A detonation wave traveling through the perforating gun assembly 200 transfers from the detonation cord 304, to the booster 332, through the gap 342, to the booster 338, and to the detonation cord 340 before transferring on to one or more additional explosive components in the additional component 336. Thus, the successful transfer of the detonation wave from the perforating gun 218 to the additional component 336 relies, at least in part, on the couplings between the detonation cord 304 and the booster 332 and the detonation cord 340 and the booster 338. The same or similar type of couplings between detonation cords and boosters may exist at each end of the each component making up the perforating gun assembly 200. This type of structure may allow each component to be separately assembled and shipped to a wellsite. At the wellsite, the perforating gun assembly 200 may he built, and the adjacent boosters may be used to transfer the detonation wave between the adjacent components. As described below, the use of the coupling method and system described herein may improve the coupling between the booster and the detonation cord, which may advantageously decrease the overall risk that a poor connection could break the explosive chain through the perforating gun assembly 200.

Figure 4:
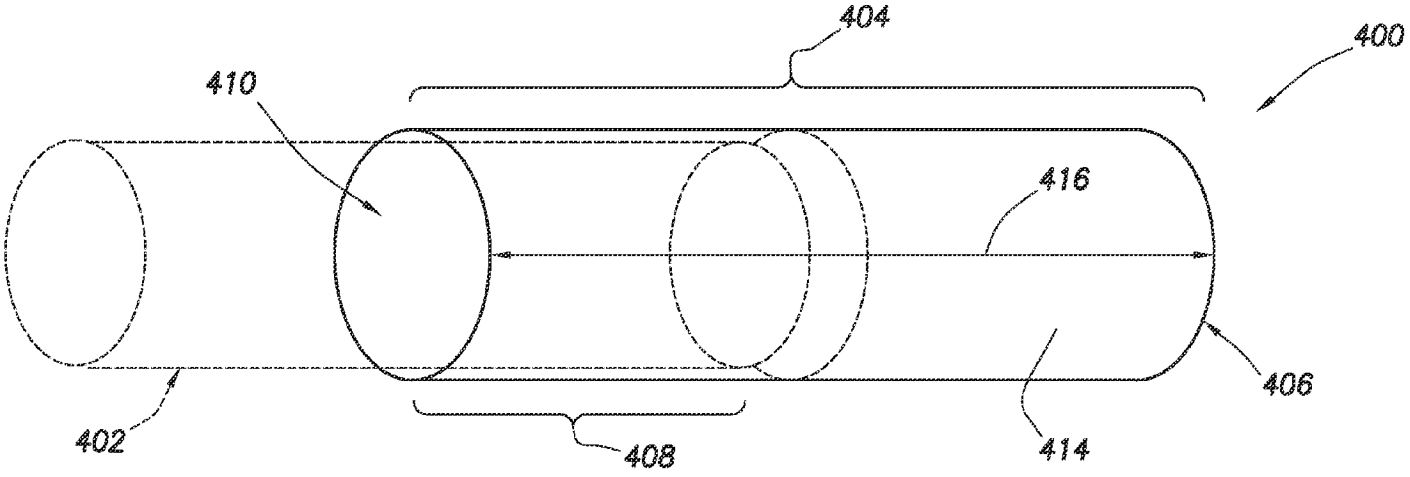
FIG. 4 is a schematic view of a booster according to an embodiment.

The booster is generally configured to transfer a detonation wave to or from a detonation cord. The booster may also be used to transfer a detonation wave both to and from other explosive components, such as the perforating charges 302 and/or adjacent boosters. In an embodiment shown in FIG. 4, the booster 400 comprises a booster body 404 having a first end 406 and a second end 410. The first end 406 may comprise a closed or capped end, and the second end 410 may generally comprise an opening through which the detonation cord 402 can pass. The booster body 404, the capped first end 406, and the second end 410 may then define a cavity within the booster 400. An explosive charge 414 may be disposed within the booster body 404 in a first portion of the cavity adjacent the first end 406, while leaving a second portion of the cavity adjacent the second end 410 available to receive the detonation cord 402. The explosive charge 414 generally comprises a secondary explosive that can be initiated by a detonation wave originating from a detonation cord 402 coupled to the booster 400 and/or a detonation wave originating from an adjacent detonation source (e.g., an adjacent booster, detonator, etc.). The detonation of the explosive charge 414 may be used to initiate the detonation cord 402 coupled to the booster 400 and/or initiate a detonation wave to initiate an adjacent booster.

A locking feature 408 may be disposed on a surface of the booster body 404 adjacent the second end 410 of the booster body 404. In an embodiment, the locking feature 408 is configured to allow the second end 410 of the booster body 404 to receive the detonation cord 402 and allow movement of the detonation cord 402 in a first direction while resisting movement of the detonation cord 402 in a second direction. In an embodiment, the first direction may be different from the second direction. In some embodiments, the first direction may be towards the interior of a cavity of the booster 400 and/or through the second end 410, and in some embodiments, the second direction may be directed away from the cavity and/or out of the second end 410. In an embodiment, the locking feature 408 may be disposed over the inner surface of the booster body 404 for at least about 5%, at least about 10%, or at least about 15% of the length 416 of cavity 410.

Figure 5:
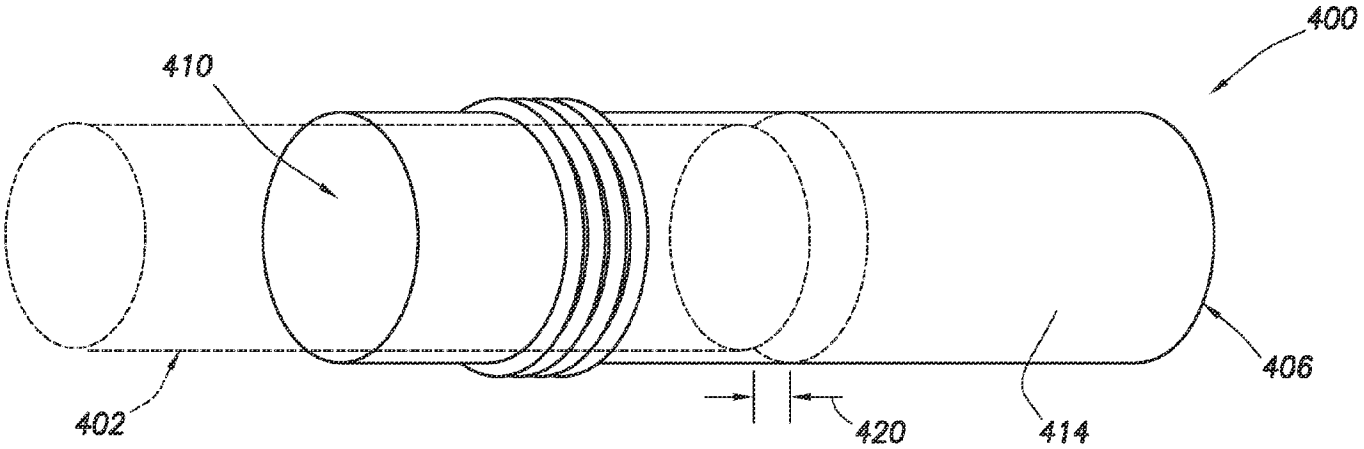
FIG. 5 is a schematic view of the crimping process according to an embodiment.
Figure 6A:
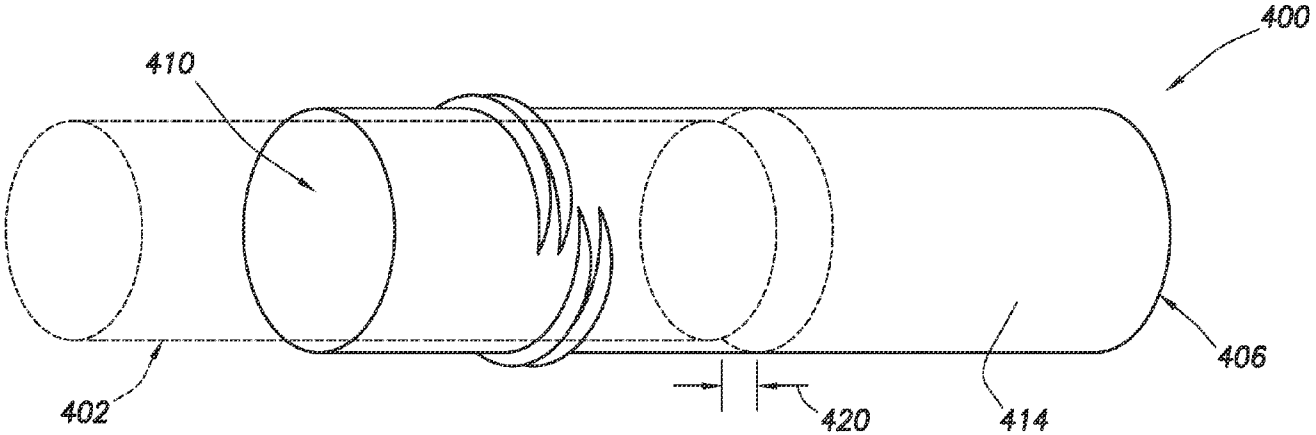
FIGS. 6A and 6B are additional schematic views of the crimping process according to an embodiment.
Figure 6B:
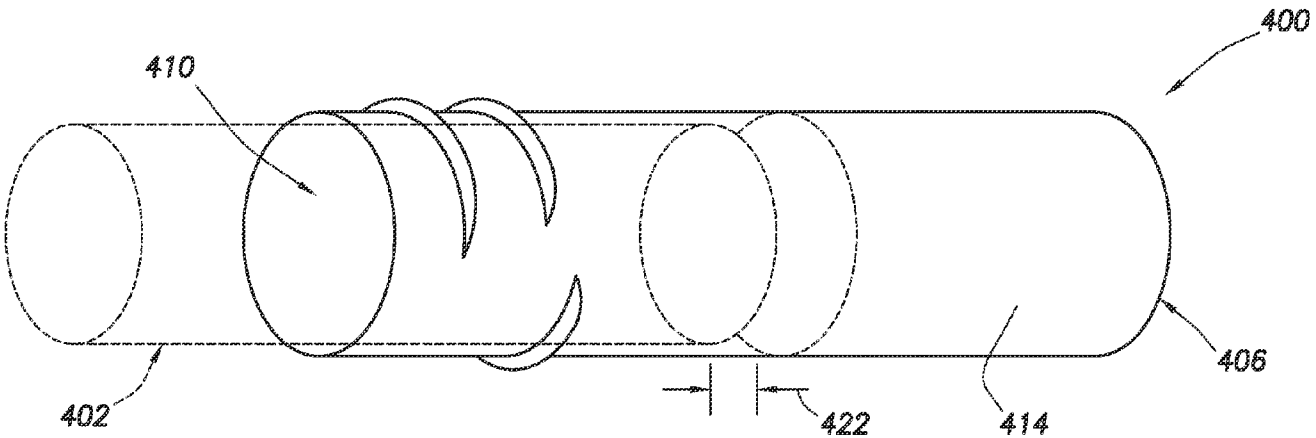

In an embodiment, the locking feature may be used alone or in combination with a crimp to couple the detonation cord 402 to the booster 400. FIGS. 5, 6A, and 6B illustrate various examples of a detonation cord 402 coupled to the booster 400 using a manual crimp. The crimp is generally formed using a manual crimping tool along with an alignment device (e.g., a vice and clamp). In this embodiment, the detonation cord 402 can be aligned within the cavity using the alignment device and the crimp may be formed at a designed area, which may be marked on the outer surface of the booster body 404. As shown in FIG. 5, a suitable crimp may have a proper alignment of the of detonation cord 402 with respect to the explosive charge 414. For example, the spacing 420 between the end of the detonation cord 402 and the explosive charge 414 within the booster body 404 in the proper coupling may allow a detonation wave to transfer between the detonation cord 402 and the explosive charge 414. FIG. 5 illustrates an embodiment of crimp in an area to provide a suitable coupling. However, as described above, the manual crimping process may result in a coupling in which the detonation cord 402 is not properly aligned with the explosive charge 414. As illustrated in FIGS. 6A and 6B, an improper or poor crimp can occur if the crimp is in the wrong location and/or if the crimp is not formed with enough force. A poor crimp may also occur if the length of detonation cord 402 is misaligned or spaced with respect to the explosive charge 414. For example, the spacing 422 between the end of the detonation cord 402 and the explosive charge 414 within the booster body 404 in the improper coupling may not allow a detonation wave to transfer between the detonation cord 402 and the explosive charge 414.

In an embodiment, the locking feature 408 may serve to couple the detonation cord 402 to the booster body 404. The locking feature 408 may also provide the proper spacing between the detonation cord 402 and the explosive charge 414, and in an embodiment, may maintain the spacing after being coupled. The locking feature 408 may be used alone or in combination with the crimping method, whether the crimp is performed with a clamp, vice and crimping tool, other tool such as pliers, or with another method known in the art of coupling the detonation cord 402 to the booster body 404. In an embodiment, various structures may be used to form the locking feature 408. Suitable locking features 408 may include, but are not limited to, one or more gripping features, an external retaining member, an adhesive, or any combination thereof. In an embodiment, the detonation cord 402 may be coupled to the booster body 404 so that the distance between the end of the detonation cord 402 and the explosive material 414 is less than about 0.1 inches, less than about 0.05 inches, or less than about 0.01 inches. In an embodiment, the detonation cord 402 may be coupled to the booster body 404 so that the detonation cord 402 engages and is maintained in contact with the explosive material 414.

Figure 7A:
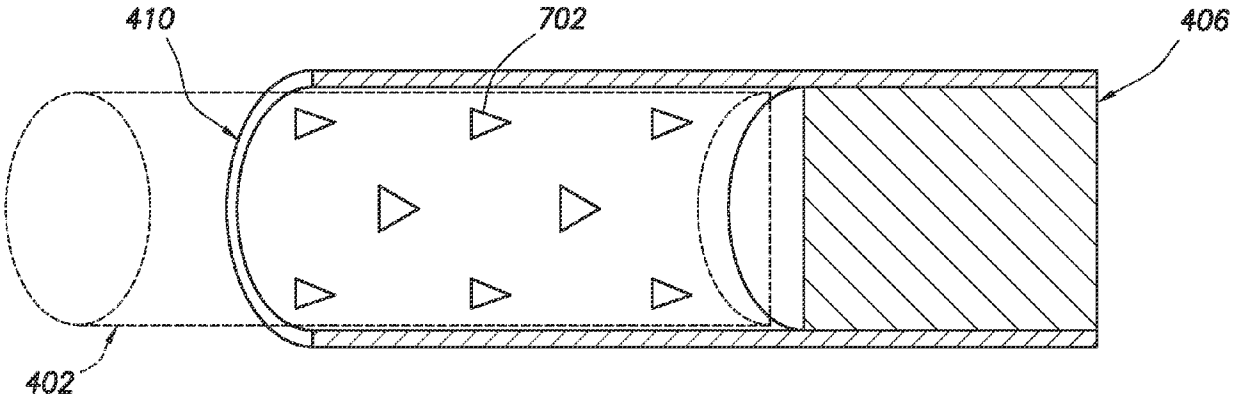
FIGS. 7A-7E are schematic views of locking features according to an embodiment.
Figure 7B:
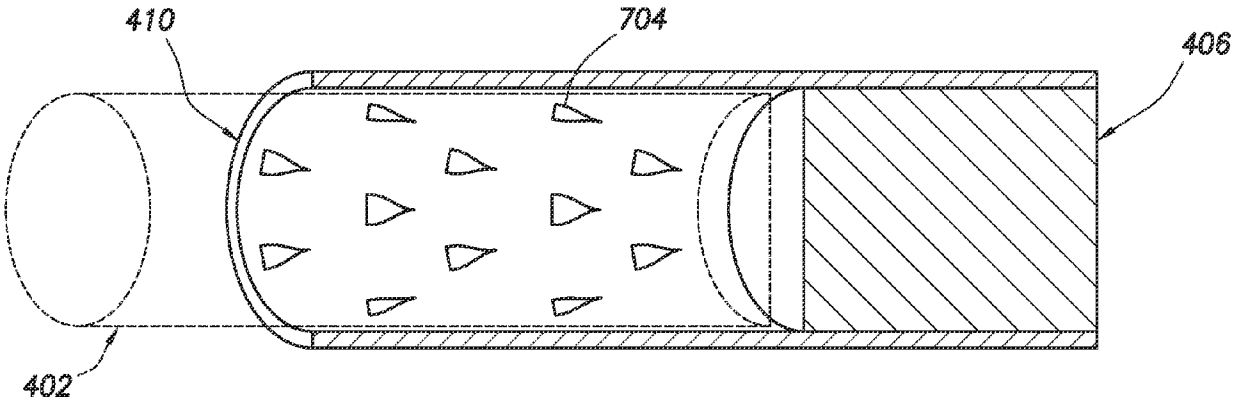
Figure 7C:
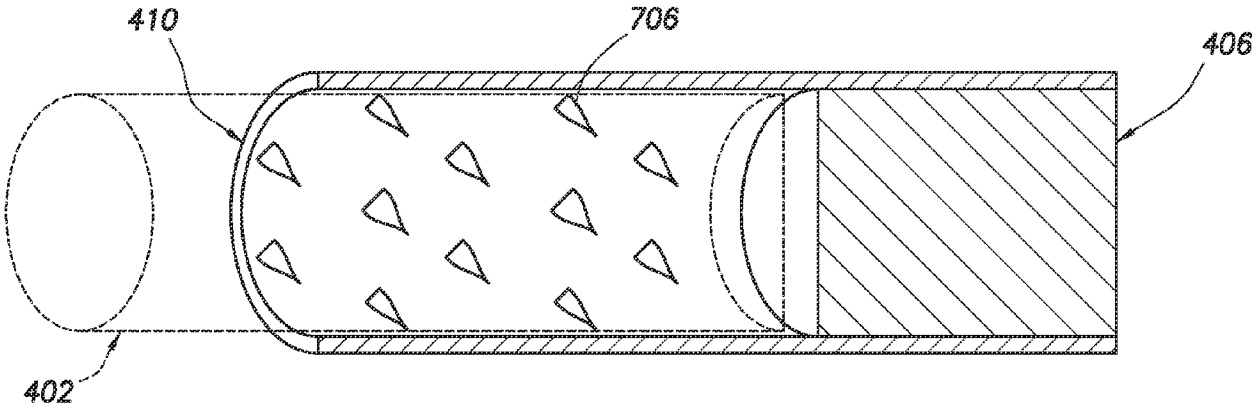

Turning to FIGS. 7A-7C, the locking feature 408 may, for example, include one or more gripping features. In an embodiment, the one or more gripping features are configured to allow the detonation cord 402 to engage the booster body 404 with a first force when the gripping feature is moved into the cavity, and the gripping feature is configured to require a second force when the gripping feature is moved in a direction out of the cavity. The second force may be greater than the first force, thereby allowing the detonation cord 402 to be moved into the cavity while requiring a larger force to be removed from the cavity. In an embodiment, the gripping feature may comprise one or more protrusions disposed on an inner surface of the booster body 404 that extend from the inner surface into the cavity. The gripping features can include, but are not limited to, sharp, tapered, and/or angled protrusions that may be directed away from the opening on the second end 410 of the booster body 404. The gripping features can include features such as teeth 702 as in FIG. 7A, curved teeth 704 as depicted in FIG. 7B, angled and curved teeth 706 as depicted in FIG. 7C, or any combination thereof. Other structures such as square teeth, angled square teeth, and/or angled triangular teeth may also be used. The one or more protrusions, such as teeth, can be aligned along the inner surface of the booster body 404 in an even or uneven distribution.

The one or more protrusions may be configured to penetrate an outer surface of the detonation cord 402 upon disposing the detonation cord into the cavity and then beginning to move the detonation cord 402 out of the cavity. As described above, the detonation cord 402 generally comprises an inner layer comprising an explosive, an optional layer of fiber, then an outer layer of insulation. The one or more protrusions may be configured to penetrate one or more of these layers, thereby providing the second force to the detonation cord 402 to maintain the detonation cord 402 within the cavity. In an embodiment, the one or more protrusions may penetrate the insulation layer on the outside of the detonation cord. In another embodiment, the one or more protrusions may penetrate through the insulation and the fiber layer. In an alternate embodiment, the one or more protrusions may penetrate through the insulation and the fiber layer and into the explosive layer. In an embodiment, the one or more protrusions may penetrate at least about 0.008 inches, at least about 0.009 inches, at least about 0.01 inches, at least about 0.03 inches, or at least about 0.05 inches into the detonation cord 402. In an embodiment, the protrusions may be angled into the cavity and away from the second end 410 of the booster body 404. For example, the angle between the inner surface of the booster body 404 at the second end 410 and the surface of the protrusion may comprise an obtuse angle. As illustrated in FIG. 7C, the one or more protrusions may be angled with respect to both the longitudinal axis of the booster 400 as well as the radial axis of the booster 400. In this embodiment, the angle between the inner surface of the booster body 404 at the second end 410 and the surface of the protrusion may comprise an obtuse angle, and the one or more protrusions may not extend towards the central longitudinal axis of the booster 400, which may be referred to as a radially offset angle. The gripping feature can be stamped, cold-formed, machined, created by a hand tool or other manual mechanical deformation, injection molded, investment cast, or by any other known way of forming one or more protrusions in a thin walled component.

In the embodiments illustrated in FIGS. 7A and 7B, the detonation cord 402 may be inserted into the cavity in the second end 410 of the booster body 404 and then retracted a distance sufficient to allow the one or more protrusions to engage the detonation cord 402. The coupling between the detonation cord 402 and the booster 400 may then be created by the penetration of the one or more protrusions into the detonation cord 402. In the embodiment illustrated in FIG. 7C, the detonation cord 402 may be aligned with and inserted into the cavity in the booster body 404. The detonation cord 402 may then be rotated and retracted into the one or more protrusions, creating a coupling when the one or more protrusions penetrate the exterior of the detonation cord 402. In an embodiment, the detonation cord 402 may be inserted into the second end 410 of the booster body 404, and the one or more protrusions, which may be directed away from the second end 410, may grip the detonation cord 402 securely after it is inserted and rotated in a direction opposite the direction that the one or more protrusions are angled.

Figure 7D:
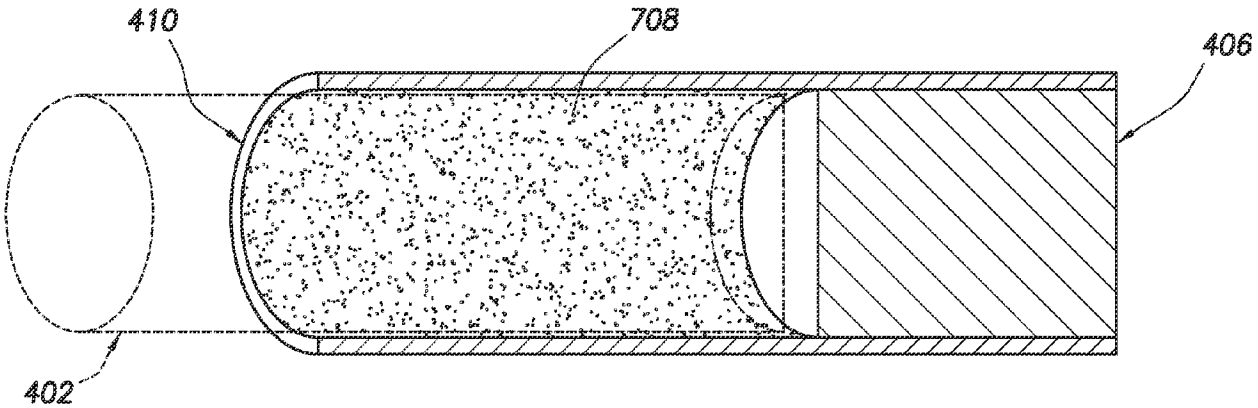

In another embodiment depicted in FIG. 7D, the locking feature 708 may comprise an adhesive material suitable for coupling the detonation cord 402 to the booster body 404. Suitable adhesive materials may be deposited on the inside of the cavity at or near the second end 410 of the booster body 404. This material may be mechanically and/or chemically adhesive. Suitable adhesive may include, but are not limited to, an epoxy, a thermosetting material, a plastic, or any combination thereof. Due to the interaction between certain adhesives and the explosive material 414 and/or the explosive material within the detonation cord 402, the suitability of an adhesive for use with a particular explosive should be verified prior to use with the booster 400. One of ordinary skill in the art with the benefit of this disclosure could verify the suitability of adhesives for use with a particular explosive. The adhesive in the embodiment FIG. 7D may be deposited through spraying, brushing, dipping, and/or any other known method for applying a liquid or colloidal mixture to the inside of the booster body 404 and/or the end of the detonation cord 402.

In order to couple the detonation cord 402 to the booster 400, the detonation cord 402 may be inserted into the cavity and maintained within the cavity for a sufficient time to allow the adhesive material to bond to the detonation cord 402, thereby creating a coupling between the inside of the cavity and the detonation cord 402. One or more crimps could optionally be formed to maintain the detonation cord in engagement with the booster 400, where the adhesive material maintains the alignment of the detonation cord 402 with respect to the booster 400 during the crimping process.

Figure 7E:
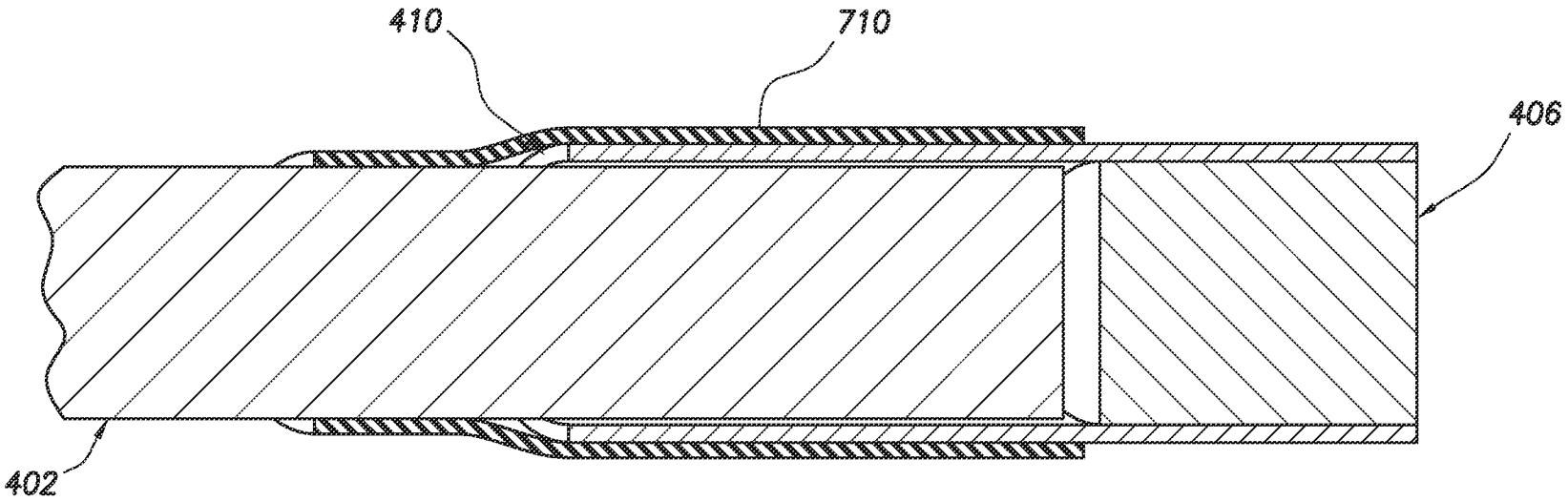

In another embodiment depicted in FIG. 7E, the locking feature 408 comprises an external retaining member 710 that can be used alone or in combination with a crimp or other manual mechanical deformation step. The external retaining member 710 may be configured to be disposed about and engage both the booster 400 and the detonation cord 402 when the detonation cord 402 is coupled to the booster 400. The external retaining member 710 may generally comprise a component that is flexible and may respond to one or more inputs to form a chemical and/or physical bond to both the booster 400 and the detonation cord 402. In an embodiment, the external retaining member 710 may comprise a portion of a shrink wrap type polymer that can contract when heated. In this embodiment, the shrink wrap may be applied through an automated or manual process, and may engage a portion of the booster body 404 and an external surface of the detonation cord 402, thereby forming a coupling between the detonation cord 402 and the booster 400. In an embodiment, the external retaining member 710 may be disposed over the booster body 404 for at least about 5%, at least about 10%, or at least about 15% of the length 416 of the cavity in the booster body 404. In an embodiment, the external retaining member 710 may be disposed over the detonation cord 402 extending beyond the second end 410 of the booster body 404 for at least about 5%, at least about 10%, or at least about 15% of the length 416 of cavity 410 in the booster body 404.

In an embodiment, a method for preparing a perforating gun assembly for use in a wellbore may comprise providing a perforating gun comprising a housing, at least one perforating charge disposed within the housing, and a detonation cord coupled to the at least one perforating charge. A booster may be coupled to an end of the detonation cord, where the booster comprises a locking feature configured to allow the booster to engage the end of the detonation cord in a first direction and resist movement in the opposite direction. In an embodiment, a second perforating gun assembly may be operably connected to the first end of the perforating gun assembly. The perforating gun assembly may then be disposed at a desired position within a wellbore. At least one of the perforating charges in the perforating gun assembly may be detonated to generate a detonation wave, which may transfer to the second perforating gun assembly as well as any subsequent operably attached assemblies through a coupling between a detonator cord and a booster comprising a locking feature as described herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure.

What is claimed is:

1. An apparatus for perforating a wellbore comprising:

a housing;

at least one perforating charge disposed within the housing;

a detonation cord coupled to the at least one perforating charge;

a booster coupled to an end of the detonation cord, wherein the booster comprises:

a booster body having a first end and a second end, a cavity formed within the booster body between the first end and the second end, wherein the cavity is defined by an inner surface of the booster body, an explosive material disposed within the cavity adjacent the first end, and a locking feature disposed adjacent the second end, wherein the locking feature is configured to allow the booster body to engage the end of the detonation cord in a first direction and resist movement in a second direction, and wherein the locking feature comprises one or more teeth disposed on the inner surface of the booster body that extend inward from the inner surface of the booster body into the cavity, wherein the detonation cord is coupled to the booster by an engagement between the teeth and the detonation cord; and a crimp formed in the booster body, wherein the crimp engages the end of the detonation cord.

2. The apparatus of claim 1, wherein the teeth penetrate a surface of the detonation cord.

3. The apparatus of claim 1, wherein the booster further comprises a second locking feature, and wherein the second locking feature comprises an external retaining member disposed about the detonation cord and the booster, an adhesive, or any combination thereof.

4. The apparatus of claim 1, wherein the first direction is towards the interior of the cavity.

5. The apparatus of claim 4, wherein the second direction is substantially opposite the first direction.

6. A booster for use with an explosive device assembly in a wellbore comprising:

at least one perforating charge;

a detonation cord coupled to the at least one perforating charge, wherein the detonation cord is coupled along its length to the at least one perforating charge, and wherein the detonation cord comprises an outer insulation layer and an inner explosive layer;

a booster body comprising a first end and a second end;

an explosive material disposed within the booster body adjacent the first end; and a locking feature disposed adjacent the second end, wherein the locking feature is configured to allow the second end of the booster body to receive an end of the detonation cord, wherein the locking feature comprises one or more teeth disposed on the inner surface of the booster body that extend inward from the inner surface, wherein the end of the detonation cord is disposed within the booster body through the second end, and wherein the one or more teeth penetrate the outer insulation layer of the detonation cord.

7. The booster of claim 6, wherein the locking feature comprises an adhesive, and wherein the adhesive is disposed between an interior surface of the booster body and the detonation cord.

8. The booster of claim 6, wherein the locking feature comprises the external retaining member, and wherein the external retaining member is disposed about an exterior of the booster body and an exterior of the detonation cord.

9. The booster of claim 6, wherein the locking feature is configured to maintain the end of the detonation cord within about 0.1 inches of the explosive material within the booster body.

10. The booster of claim 6, wherein the locking feature is configured to maintain the end of the detonation cord in engagement with the explosive material within the booster body.

11. The booster of claim 6, wherein the locking feature is disposed over a surface of the booster body for at least about 5% of a length of the booster body.

12. The booster of claim 6, further comprising a crimp in the booster body, wherein the crimp engages the detonation cord.

13. A method for preparing a perforating gun assembly for use in a wellbore comprising:

providing a perforating gun comprising a housing, at least one perforating charge disposed within the housing, and a detonation cord coupled along its length to the at least one perforating charge; and coupling a booster to an end of the detonation cord using a locking feature, wherein the booster comprises a cavity formed within a booster body, wherein an explosive material is disposed within the cavity adjacent a first end of the booster body, wherein the end of the detonation cord is inserted into a second end of the booster body, wherein the locking feature is configured to allow the booster to engage the end of the length of the detonation cord in a first direction into the second end of the booster body and resist movement in the opposite direction out of the cavity;

maintaining an alignment between the booster and the detonation cord using the locking feature after coupling the booster to the end of the detonation cord; and crimping the booster to the detonation cord while the locking feature maintains the alignment between the booster and the detonation cord.

14. The method of claim 13, wherein the locking feature comprises an adhesive, an external retaining member, or any combination thereof.

15. The method of claim 13, further comprising disposing the perforating gun assembly in a wellbore.

16. The method of claim 15, further comprising detonating the at least one of the perforating charges in the perforating gun assembly.

17. The method of claim 13, wherein the locking feature further comprises one or more gripping features.

18. The method of claim 17, wherein the one or more gripping features comprise one or more protrusions disposed on an inner surface of the booster body that extend inward from the inner surface.

19. The method of claim 17, wherein the one or more gripping features are configured to penetrate a surface of the detonation cord.

20. The method of claim 19, wherein coupling the booster to the end of the detonation cord using the locking feature comprises:

inserting the end of the detonation cord into the second end of the booster body, retracting the end of the detonation cord, and penetrating the surface of the detonation cord with the gripping features in response to retracting the end of the detonation cord.

* * * * *